US012037174B2

(12) United States Patent
Tanaka et al.

(10) Patent No.: US 12,037,174 B2
(45) Date of Patent: Jul. 16, 2024

(54) POUCH AND FILLING METHOD

(71) Applicant: Toyo Seikan Co., Ltd., Tokyo (JP)

(72) Inventors: Hiroki Tanaka, Yokohama (JP); Motohide Hata, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 119 days.

(21) Appl. No.: 17/974,992

(22) Filed: Oct. 27, 2022

(65) Prior Publication Data

US 2023/0047940 A1 Feb. 16, 2023

Related U.S. Application Data

(63) Continuation of application No. PCT/JP2021/006250, filed on Feb. 19, 2021.

(30) Foreign Application Priority Data

Apr. 28, 2020 (JP) ..... 2020-079661

(51) Int. Cl.
*B65D 75/30* (2006.01)
*B65D 33/02* (2006.01)
(Continued)

(52) U.S. Cl.
CPC ..... *B65D 75/30* (2013.01); *B65D 33/02* (2013.01); *B65D 75/008* (2013.01); *B65D 75/566* (2013.01); *B65D 75/5877* (2013.01)

(58) Field of Classification Search
CPC ..... B65D 33/02; B65D 75/28; B65D 75/30; B65D 75/008; B65D 75/566; B65D 75/5877
See application file for complete search history.

(56) References Cited

U.S. PATENT DOCUMENTS 4,904,093 A * 2/1990 Woods ..... B65D 31/02 383/122
6,591,874 B2 * 7/2003 Credle, Jr. ..... B65D 75/5877 141/10
(Continued)

FOREIGN PATENT DOCUMENTS

JP 9-238746 A 9/1997
JP 2000-272670 A 10/2000
(Continued)

OTHER PUBLICATIONS

International Search Report dated May 11, 2021, issued in counterpart International Application No. PCT/JP2021/006250. (2 pages).

*Primary Examiner* — Nicolas A Arnett
(74) *Attorney, Agent, or Firm* — WHDA, LLP

(57) ABSTRACT

To provide a pouch that allows a displacement of the formation position of a film through portion to be detected. A pouch includes an inner film (70) disposed in a pouch body (20), the inner film (70) including a first fixing portion (71) fixed to a pouch body (20), a second fixing portion (72) fixed to the pouch body (20), an inner placement portion (75) that is disposed in the pouch body (20) without being fixed to the pouch body (20), and a plurality of film through portions (76) penetrating in a film thickness direction, the plurality of film through portions (76) including a first film-through portion (76*a*) at least partially formed on the first fixing portion (71) and an inner film-through portion (76*c*) formed on the inner placement portion (75), the first film-through portion (76*a*) being overlapped on the body film in a bag-making sealing portion (23).

11 Claims, 4 Drawing Sheets

(51) Int. Cl.

| | |
|---|---|
| ***B65D 75/00*** | (2006.01) |
| ***B65D 75/56*** | (2006.01) |
| ***B65D 75/58*** | (2006.01) |

(56) References Cited

U.S. PATENT DOCUMENTS

| | | | | |
|---|---|---|---|---|
| 10,934,073 | B2 * | 3/2021 | Abe | B65D 75/008 |
| 2008/0240622 | A1 * | 10/2008 | Bell | B65D 33/00 383/5 |
| 2009/0196537 | A1 * | 8/2009 | Aikawa | B65D 75/5883 383/120 |
| 2010/0172600 | A1 * | 7/2010 | Sherrill | B65D 75/008 493/267 |
| 2015/0125097 | A1 * | 5/2015 | Kenmotsu | B65D 33/16 383/42 |
| 2015/0274392 | A1 * | 10/2015 | Pease | B65D 75/48 493/243 |
| 2016/0325976 | A1 * | 11/2016 | Guy | B67D 7/0216 |
| 2017/0008675 | A1 * | 1/2017 | Umenaka | B65D 75/008 |
| 2021/0362928 | A1 * | 11/2021 | Tanaka | B65D 81/3261 |

FOREIGN PATENT DOCUMENTS

| | | | |
|---|---|---|---|
| JP | 2010-120686 | A | 6/2010 |
| JP | 2012-121611 | A | 6/2012 |
| JP | 2017-507083 | A | 3/2017 |
| JP | 2020-132177 | A | 8/2020 |

* cited by examiner

POUCH AND FILLING METHOD

TECHNICAL FIELD

The present invention relates to a pouch having gusset portions and a filling method for filling the pouch with a content fluid.

BACKGROUND ART

Conventionally, as a container for containing a content fluid, e.g., drinking water or a liquid detergent, a pouch shaped like a bag is known, the pouch being formed by heat-sealing a plurality of body films to form bag-making sealing portions (for example, see Patent Literature 1).

Moreover, as disclosed in Patent Literature 1, it is also known that a pouch in a so-called back-in-box form, that is, a pouch stored in an outer case is handled when being used (when a content fluid is discharged), displayed, or transported.

However, a resin film constituting such a pouch is flexible, so that a pouch formed with a large capacity may have a so-called body expansion, which is an expansion in the lower part of a pouch body, due to the weight of a content fluid.

In the case of the body expansion, a large installation space is necessary for the pouch when the pouch is used, displayed, or transported. If the pouch is handled in the back-in-box form, the outer case requires strength in consideration of the body expansion of the pouch.

Thus, as a proposal for solving the problem, the present applicant proposed in Patent Literature 2 that an inner film is disposed in a pouch body, the inner film prevents a first fixed portion and a second fixed portion of the pouch body from separating from each other with a content fluid storage portion interposed between the first and second fixed portions opposed to each other, and thus the overall shape of the pouch containing the content fluid is kept so as to prevent a so-called body expansion that is an expansion in the lower part of the pouch body due to the weight of a content fluid having flowability, e.g., drinking water.

CITATION LIST

Patent Literatures

[Patent Literature 1] Japanese Patent Application Publication No. 2012-121611

[Patent Literature 2] Japanese Patent Application No. 2019-025347

SUMMARY OF INVENTION

Technical Problem

In Patent Literature 2, a hole portion or a notch portion that is formed as a film through portion on the inner film is also proposed to prevent the installation of the inner film from interfering with a flow of the content fluid in the content fluid storage portion.

Unfortunately, in a state in which the pouch containing the content fluid is completed, whether the portion passing through the film is formed at a predetermined position cannot be confirmed from the outside.

Specifically, it is also assumed that the position of the portion passing through the film may be displaced when the portion is formed on the inner film in the steps of manufacturing the pouch. If the pouch containing the content fluid is completed while the inner film where the formation position of the portion passing through the film is displaced, the formation position of the portion passing through the film may be hard to confirm from the outside.

Hence, the present invention is devised to solve the problems. An object of the present invention is to provide a pouch and a filling method that can detect, with a simple configuration, a displacement of the formation position of a film through portion even when the pouch containing a content fluid is finished.

Solution to Problem

A pouch according to the present invention is a pouch having a gusset portion, the pouch including a pouch body formed like a bag by heat-sealing a plurality of body films to form a bag-making sealing portion, and an inner film disposed in the pouch body, wherein the pouch body includes a content fluid storage portion, and a first fixed portion and a second fixed portion that are opposed to each other with the content fluid storage portion interposed between the fixed portions, the inner film includes a first fixing portion fixed to the first fixed portion, a second fixing portion fixed to the second fixed portion, an inner placement portion that is disposed in the pouch body without being fixed to the pouch body, and a plurality of film through portions that are formed like holes penetrating in a film thickness direction or notches, the plurality of film through portions include a first film-through portion at least partially formed on the first fixing portion, and an inner film-through portion formed on the inner placement portion, and the first film-through portion is overlapped on the body film in the bag-making sealing portion. The pouch configured thus solves the problems.

A filling method according to the present invention is a filling method for filling the pouch with a content fluid, wherein the plurality of film through portions include a second film-through portion at least partially formed on the second fixing portion, the second film-through portion is overlapped on the body film in the bag-making sealing portion, the first film-through portion is formed over the first fixing portion and the inner placement portion, the second film-through portion is formed over the second fixing portion and the inner placement portion, the content fluid storage portion includes a first storage region and a second storage region that are separated by the inner film, and a spout having a spout outlet is attached to a position where the spout communicates with the first storage region of the pouch body, the method including, with the second storage region located under the first storage region, inserting a filling nozzle into the second storage region from the outside of the pouch through the spout outlet and the inner film-through portion; and moving gas in the second storage region into the first storage region through the first film-through portion and the second film-through portion while supplying the content fluid from the filling nozzle into the second storage region during the filling of the content fluid. The method devised thus solves the problems.

Advantageous Effects of Invention

According to one aspect of the present invention, the inner film disposed in the pouch body prevents the first fixed portion and the second fixed portion of the pouch body from separating from each other with the content fluid storage portion interposed between the first and second fixed portions opposed to each other, and thus the overall shape of the pouch containing the content fluid is kept so as to prevent a so-called body expansion that is an expansion in the lower part of the pouch body due to the weight of a content fluid having flowability, e.g., drinking water. This can reduce the installation space of the pouch when the pouch is used, displayed, or transported. If the pouch is handled in the back-in-box form, the need for providing high strength for an outer case accommodating the pouch can be eliminated, and the following effect is further obtained:

In other words, in the invention according to the aspect, the inner film disposed in the pouch body includes a first film-through portion at least partially formed on the first fixing portion, and an inner film-through portion that is formed on the inner placement portion that is disposed in the pouch body without being fixed to the pouch body, the first film-through portion being overlapped on the body film in the bag-making sealing portion. In this way, the first film-through portion is formed at a position overlapping the body film in the bag-making sealing portion, so that the formation position of the first film-through portion on the inner film can be confirmed from the outside by using a change of the thickness of the bag-making sealing portion. The formation position of the inner film-through portion disposed in the pouch body can be estimated on the basis of the confirmed formation position of the first film-through portion, thereby detecting a displacement of the formation position of the inner film-through portion with a simple configuration.

According to another aspect of the present invention, the first film-through portion is formed over the first fixing portion and the inner placement portion, so that gas such as air, which is likely to be left around a fixed portion between the pouch body and the inner film, can be passed through the first film-through portion in the pouch body. Thus, gas such as air in the pouch body can be properly discharged to the outside when the pouch body is filled with a content fluid.

According to another aspect of the present invention, the spout is attached to a position that is located at one side of the pouch body and closer to the body bottom than a center in a height direction, and the first fixing portion having the first film-through portion is formed at the body bottom. Thus, when filling the pouch body with a content fluid through the spout while holding the spout to hang the pouch, gas such as air in the pouch body can be passed through the first film-through portion, so that gas such as air in the pouch body can be properly discharged to the outside.

According to another aspect of the present invention, the plurality of film through portions include a second film-through portion at least partially formed on the second fixing portion, and the second film-through portion is overlapped on the body film in the bag-making sealing portion. Thus, the formation positions of the first film-through portion and the second film-through portion, which are formed on both sides of the inner film-through portion, can be confirmed from the outside by using a change of the thickness of the bag-making sealing portion. This can more reliably detect a displacement of the formation position of the inner film-through portion.

According to another aspect of the present invention, the inner film has a to-be-bent portion that is bent at the body bottom when the pouch containing a content fluid is placed on a loading surface with the body bottom placed at the bottom of the pouch, and at least one of the film-through portions is formed over the to-be-bent portion. Thus, the content fluid can be passed through the film through portion formed at the to-be-bent portion, and interference with the passage of the content fluid by the inner film around the body bottom can be suppressed, thereby reducing a residual content fluid remaining around the body bottom.

According to another aspect of the present invention, the inner film has a fluid-level contact portion that comes into contact with the fluid level of a content fluid when the sealed pouch containing the content fluid is placed on the loading surface with the body bottom placed at the bottom of the pouch, and at least one of the film-through portions is formed over the fluid-level contact portion. Thus, when the sealed pouch containing the content fluid is placed on the loading surface with the body bottom placed at the bottom of the pouch, gas such as air and the content fluid and the content fluid can be passed between the first storage region and the second storage region through the film through portion formed at the fluid-level contact portion, thereby preventing a difference between the height of the fluid level of the content fluid in the first storage region and the height of the fluid level of the content fluid in the second storage region.

According to another aspect of the present invention, the first fixing portion of the inner film is disposed between the two body films and is heat-sealed to the two body films in the bag-making sealing portion so as to be fixed to the pouch body. Thus, the bag-making sealing portion can be formed and the first fixing portion of the inner film can be fixed to the pouch body at the same time, thereby reducing the burden of manufacturing the pouch.

According to another aspect of the present invention, the inner film is configured as a resin film having a heat-sealing layer and is bent into two with the heat-sealing layer facing outward, and the first fixing portion and the second fixing portion that are bent into two are disposed between the two body films and are heat-sealed to the two body films in the bag-making sealing portion. Thus, the need for forming heat-sealing layers on both surfaces of the inner film is eliminated, and strength can be improved in a portion where the first fixing portion or the second fixing portion is disposed between the two body films.

According to another aspect of the present invention, the inner films are all installed such that the film bending portion faces the first storage region, the film bending portion being formed by bending the inner film into two. Thus, when a content fluid is discharged, the content fluid in the second storage region can be smoothly guided into the first storage region by the inner film. Furthermore, when the pouch body is filled with a content fluid through the spout, gas such as air in the second storage region can be smoothly guided into the first storage region by the inner film.

According to another aspect of the present invention, with the second storage region located under the first storage region, the filling nozzle is inserted into the second storage region from the outside of the pouch through the spout outlet and the inner film-through portion, and gas in the second storage region is moved into the first storage region through the first film-through portion and the second film-through portion while the content fluid from the filling nozzle is supplied into the second storage region during the filling of the content fluid. Thus, even if the second storage region is filled with a content fluid that is likely to foam during the filling of a liquid detergent or the like, the filling of the content fluid can be properly achieved while suppressing foaming in the pouch.

DESCRIPTION OF EMBODIMENTS

A pouch 10 according to a first embodiment of the present invention will be described below in accordance with the accompanying drawings.

Figure 1:
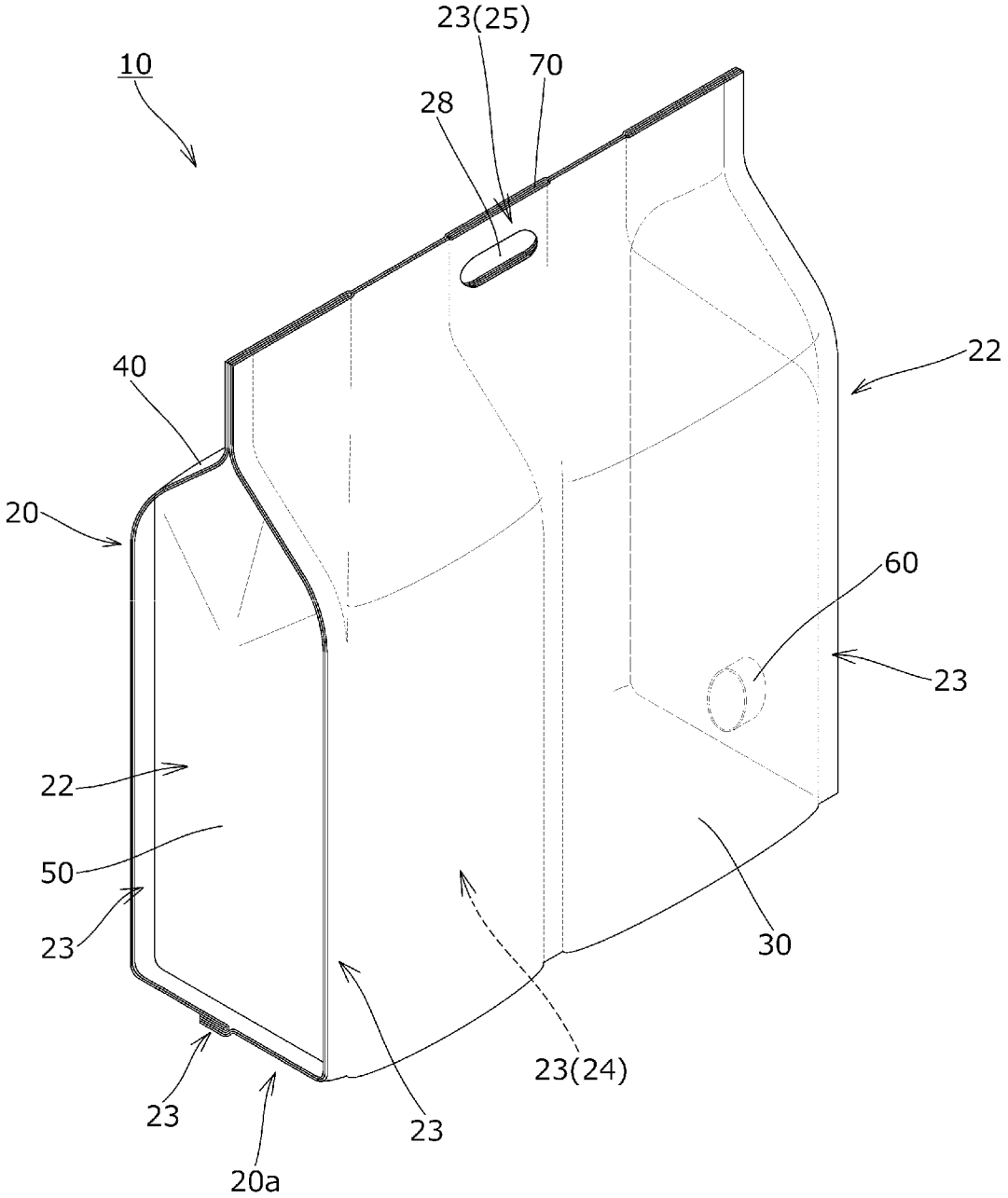
FIG. 1 is a perspective view illustrating a pouch according to a first embodiment of the present invention, the pouch being placed on a loading surface in a usage state.
Figure 2:
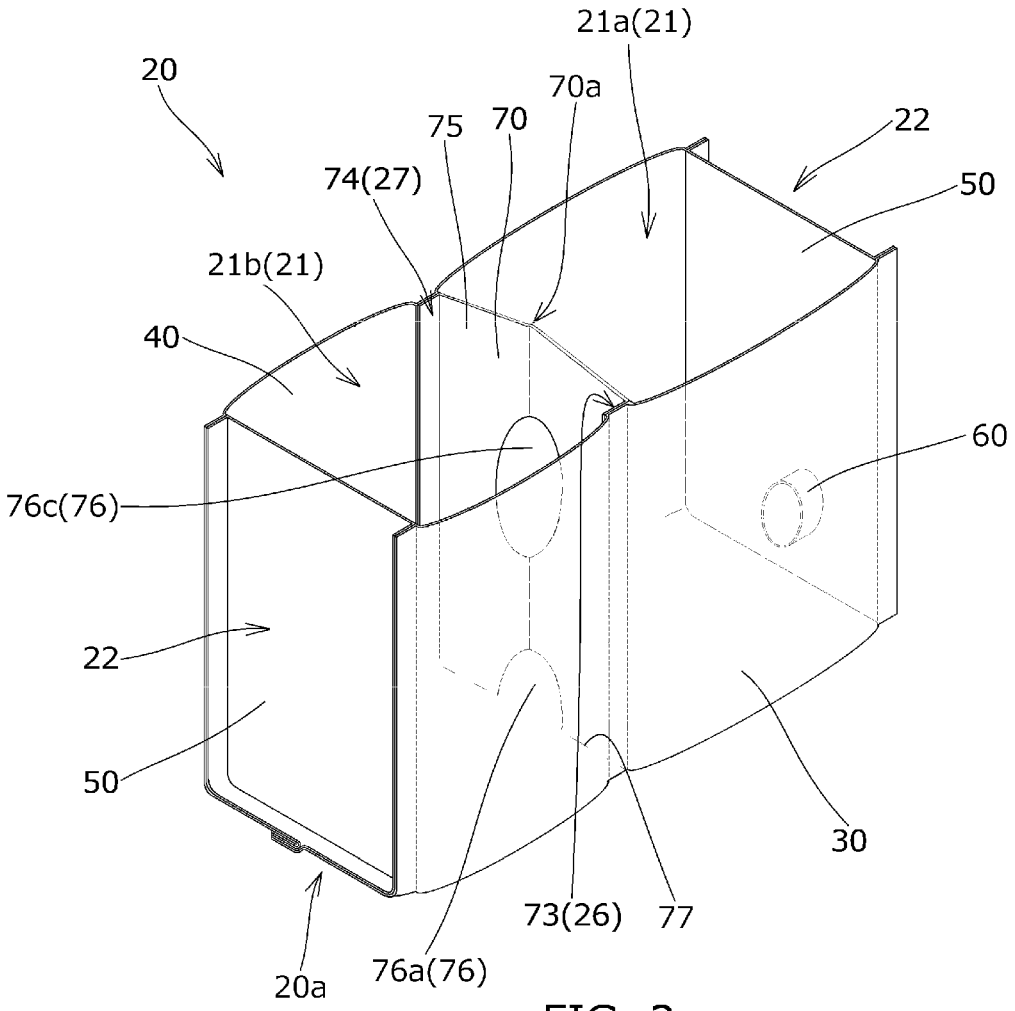
FIG. 2 is a cross-sectional perspective view illustrating the pouch.

As illustrated in FIGS. 1 and 2, the pouch 10 is configured to contain a content fluid, e.g., drinking water or a liquid detergent and includes a pouch body 20 formed into a bag from a flexible resin film, a spout 60 attached to the pouch body 20, and an inner film 70 disposed in the pouch body 20. When being used, displayed, or transported, the pouch 10 is handled while being stored in an outer case (not illustrated).

As illustrated in FIGS. 1 and 2, the pouch body 20 is shaped like a bag by heat-sealing a plurality of body films 30, 40, and 50, each of which includes a resin film, to form bag-making sealing portions 23. Specifically, the pouch body 20 is shaped like a bag by forming the bag-making sealing portions 23 by heat-sealing a front-side film 30, a back-side film 40, and a pair of gusset portion films 50 around a content fluid storage portion 21. In the present embodiment, the pouch is configured as a pouch of a so-called horizontal gusset type with gusset portions 22 formed on both sides of the pouch.

As illustrated in FIG. 1, the pouch body 20 includes a body bottom 20*a* that serves as a bottom when the pouch 10 is placed on a loading surface (not illustrated) in a usage state (drainage standby state) of the pouch 10 from which a content fluid can be drained through the spout 60.

Figure 3:
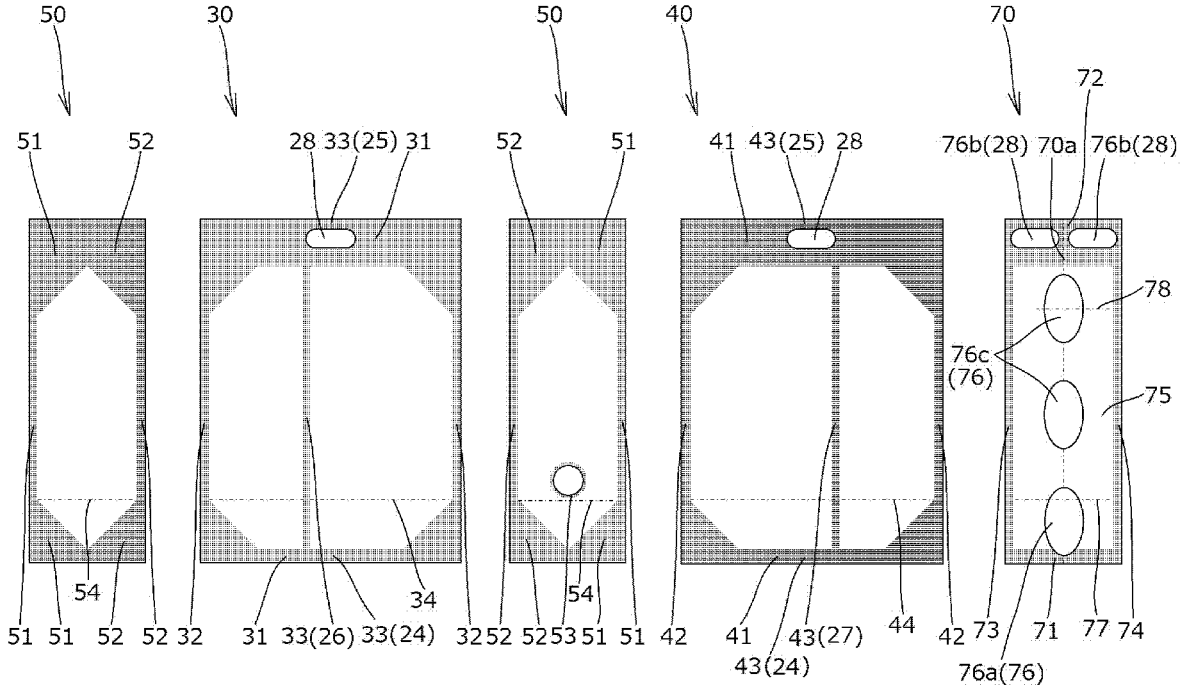
FIG. 3 is an explanatory drawing illustrating films constituting the pouch.

While the pouch 10 is placed on the flat loading surface (horizontal surface), the body bottom 20*a* is a portion where the films 30, 40, 50, and 70 are bent onto the loading surface (not illustrated) according to the weight of a content fluid. In the present embodiment, parts of the films 30, 40, 50, and 70 constitute the body bottom 20*a*. FIG. 3 illustrates to-be-bent portions 34, 44, 54, and 77 of the films 30, 40, 50, and 70.

The films 30, 40, and 50 are formed as rectangular (or substantially rectangular) resin films, each having a heat-sealing layer on at least one surface. The films are disposed with the heat-sealing layers opposed to each other at a portion where the films are to be heat-sealed. In the present embodiment, the films 30, 40, and 50 constitute the body films.

The films 30, 40, and 50 have heat-sealing regions as follows: In FIG. 3 (and FIGS. 4 to 6), the heat-sealing regions are illustrated in a dotted pattern.

As illustrated in FIG. 3, the front-side film 30 includes first heat-sealing regions 31 to be heat-sealed along with the back-side film 40, second heat-sealing regions 32 to be heat-sealed along with the gusset portion films 50, and third heat-sealing regions 33 to be heat-sealed along with the inner film 70.

As illustrated in FIG. 3, the back-side film 40 includes first heat-sealing regions 41 to be heat-sealed along with the front-side film 30, second heat-sealing regions 42 to be heat-sealed along with the gusset portion films 50, and third heat-sealing regions 43 to be heat-sealed along with the inner film 70.

As illustrated in FIG. 3, the gusset portion film 50 includes first heat-sealing regions 51 to be heat-sealed along with the front-side film 30 and second heat-sealing regions 52 to be heat-sealed along with the back-side film 40. Furthermore, the gusset portion film 50 has a third heat-sealing region 53 to be heat-sealed along with the spout 60.

The spout 60 is made of a synthetic resin or the like and is attached to the pouch body 20 so as to serve as an outlet of a content fluid.

In the present embodiment, as illustrated in FIG. 1, the spout 60 is fixed to one side of the pouch body 20, specifically, one of the gusset portions 22 (gusset portion films 50) by heat sealing.

As illustrated in FIG. 1, the spout 60 is attached to a position that is located at one side (the gusset portion 22, the gusset portion film 50) of the pouch body 20 and closer to the body bottom 20*a* than the center in the height direction (the center of the gusset portion film 50 in the longitudinal direction).

As illustrated in FIG. 2, the content fluid storage portion 21 includes a first storage region 21*a* and a second storage region 21*b* that are separated by the inner film 70. The spout 60 is attached to the position where the spout 60 communicates with the first storage region 21*a*.

As illustrated in FIGS. 2 and 3, the inner film 70 is formed as a rectangular (or substantially rectangular) and flexible resin film having a heat-sealing layer on at least one surface. The inner film 70 is disposed in the pouch body 20 (content fluid storage portion 21) while being bent into two at a film bending portion 70*a*, which linearly extends along the vertical direction (the longitudinal direction of the inner film 70), with the heat-sealing layer facing outward.

As illustrated in FIG. 2, the inner film 70 is installed such that the film bending portion 70*a* (a protrusion thereof), which is formed by bending the inner film 70 into two, faces the first storage region 21*a*.

As a modification, a plurality of inner films 70 configured thus may be installed. Also in this case, the inner films 70 are each preferably installed with the film bending portion 70*a* (a protrusion thereof) facing the first storage region 21*a*.

As illustrated in FIG. 3, the inner film 70 has a first fixing portion 71, which is fixed to a first fixed portion 24 of the pouch body 20, on one end of the inner film 70 in the longitudinal direction and a second fixing portion 72, which is fixed to a second fixed portion 25 of the pouch body 20, on the other end of the inner film 70 in the longitudinal direction, the second fixed portion 25 being opposed to the first fixed portion 24 with the content fluid storage portion 21 interposed therebetween.

As illustrated in FIGS. 1 and 3, the first fixing portion 71 is disposed between the front-side film 30 and the back-side film 40 and is heat-sealed along with the front-side film 30 and the back-side film 40 while the heat-sealing layer of the first fixing portion 71 in the bag-making sealing portion 23 on the bottom side of the pouch 10 is bent into two so as to face the heat-sealing layer of the front-side film 30 and the heat-sealing layer of the back-side film 40. In the present embodiment, as illustrated in FIG. 1, the first fixing portion 71 is formed at the body bottom 20*a*, and a part of the bag-making sealing portion 23 on the bottom side of the pouch 10 serves as the first fixed portion 24 of the pouch body 20.

As illustrated in FIGS. 1 and 3, the second fixing portion 72 is disposed between the front-side film 30 and the back-side film 40 and is heat-sealed along with the front-side film 30 and the back-side film 40 while the heat-sealing layer of the second fixing portion 72 in the bag-making sealing portion 23 on the top side of the pouch 10 is bent into two so as to face the heat-sealing layer of the front-side film 30 and the heat-sealing layer of the back-side film 40. In the present embodiment, as illustrated in FIG. 1, a part of the bag-making sealing portion 23 on the top side of the pouch 10 serves as the second fixed portion 25 of the pouch body 20.

At the first fixing portion 71 and the second fixing portion 72, the inner sides of the inner film 70 bent into two are also heat-sealed. For example, a heat-sealing layer is provided on each surface of the inner film 70 or the inner film 70 is provided as a single film made of a heat-sealing material, enabling heat-sealing between the inner sides of the inner film 70.

As illustrated in FIG. 3, the inner film 70 has a third fixing portion 73, which is fixed to a third fixed portion 26 of the pouch body 20, on one end of the inner film 70 in the width direction and a fourth fixing portion 74, which is fixed to a fourth fixed portion 27 of the pouch body 20, on the other end of the inner film 70 in the width direction, the fourth fixed portion 27 being opposed to the third fixed portion 26 with the content fluid storage portion 21 interposed therebetween.

As illustrated in FIG. 2, the third fixing portion 73 is disposed with the heat-sealing layer opposed to the heat-sealing layer on the inner side of the front-side film 30, and is heat-sealed along with the inner side of the front-side film 30. In the present embodiment, a part of the inner side of the front-side film 30 serves as the third fixed portion 26 of the pouch body 20.

As illustrated in FIG. 2, the fourth fixing portion 74 is disposed with the heat-sealing layer opposed to the heat-sealing layer on the inner side of the back-side film 40 and is heat-sealed along with the inner side of the back-side film 40. In the present embodiment, a part of the inner side of the back-side film 40 serves as the fourth fixed portion 27 of the pouch body 20.

As illustrated in FIG. 1, the inner film 70 further includes an inner placement portion 75 that is a region formed inside the fixing portions 71 to 74 and is disposed in the pouch body 20 without being fixed to the pouch body 20.

As illustrated in FIGS. 2 and 3, the inner film 70 has a plurality of film through portions 76 that are formed like holes passing through the film in the thickness direction.

In the present embodiment, as illustrated in FIG. 3, the film through portions 76 include a first film-through portion 76*a* formed over the first fixing portion 71 and the inner placement portion 75, second film-through portions 76*b* formed on the second fixing portion 72, and a plurality of (two) inner film-through portions 76*c* formed on the inner placement portion 75.

A part of the first film-through portion 76*a* and the inner film-through portions 76*c* serve as portions that pass a content fluid and gas such as air between the first storage region 21*a* and the second storage region 21*b*.

Apart formed on the first fixing portion 71 in the first film-through portion 76*a* is disposed on the body films 30 and 40 in the bag-making sealing portion 23.

As illustrated in FIG. 1, the second film-through portion 76*b* is formed by collectively forming through holes 28 in a portion where the films 30, 40, and 70 overlap one another in the bag-making sealing portion 23 on the top side of the pouch 10. The through holes 28 serve as holding holes for holding the pouch 10 with a hand or fingers of a user.

At least one of the film through portions 76 is formed over the film bending portion 70*a*. In the present embodiment, as illustrated in FIGS. 2 and 3, the first film-through portion 76*a* and the inner film-through portions 76*c* are formed over the film bending portion 70*a*.

As illustrated in FIGS. 2 and 3, the inner film 70 has a to-be-bent portion 77 that is bent at the body bottom 20*a* (in other words, on the loading surface) when the pouch 10 containing a content fluid is placed on the loading surface with the body bottom 20*a* placed at the bottom of the pouch.

The to-be-bent portion 77 is a linear portion extending along the horizontal direction (the width direction of the inner film 70) as illustrated in FIGS. 2 and 3.

At least one of the film through portions 76 is formed over the to-be-bent portion 77. In the present embodiment, as illustrated in FIGS. 2 and 3, the first film-through portion 76*a* is formed over the to-be-bent portion 77.

The inner film 70 has a fluid-level contact portion 78 that comes into contact with the fluid level of a content fluid when the sealed pouch 10 containing the content fluid is placed on the loading surface with the body bottom 20*a* placed at the bottom of the pouch.

The fluid-level contact portion 78 is a linear portion extending along the horizontal direction (the width direction of the inner film 70) as illustrated in FIG. 3.

At least one of the film through portions 76 is formed over the fluid-level contact portion 78. In the present embodiment, upper one of the two inner film-through portions 76*c* is formed over the fluid-level contact portion 78.

During the manufacturing of the pouch 10, the inner film 70 having the first film-through portion 76*a* and the second film-through portions 76*c* is prepared, the inner film 70 is heat-sealed along with the body films 30 and 40, and then the second film-through portion 76*b* (through hole 28) is formed through the films 30, 40, and 70.

In the pouch 10 of the present embodiment obtained thus, the first film-through portion 76*a* formed on the inner film 70 is overlapped on the body films 20 and 30 in the bag-making sealing portion 23.

In this way, the first film-through portion 76*a* is formed at a position overlapping the body films 20 and 30 in the bag-making sealing portions 23, so that the formation position of the first film-through portion 76*a* on the inner film 70 can be confirmed from the outside by using a change of the thickness of the bag-making sealing portion 23. Even if the formation positions of the inner film-through portions 76*c* disposed in the pouch body 20 cannot be confirmed from the outside on the basis of the formation position of the first film-through portion 76*a*, the formation positions of the inner film-through portions 76*c* disposed in the pouch body 20 can be estimated.

Figure 4:
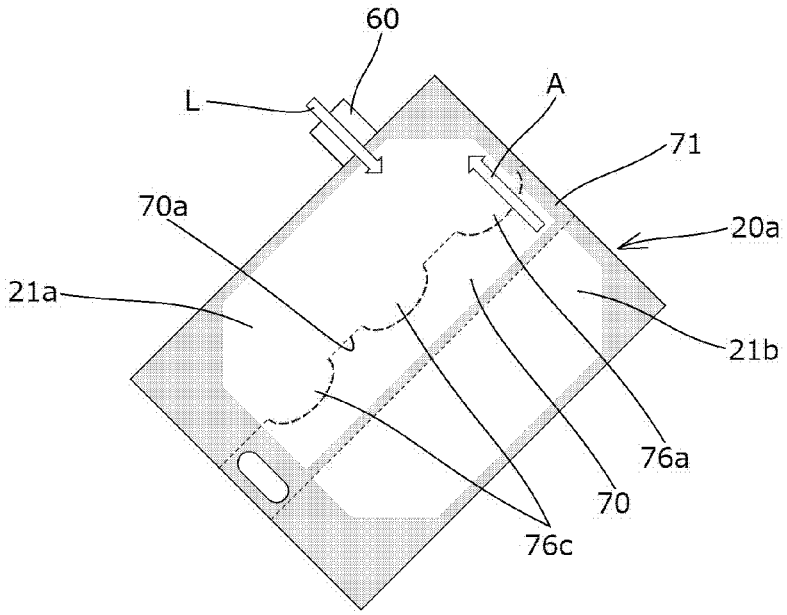
FIG. 4 is an explanatory drawing illustrating the pouch that is hung while a spout is held.

Moreover, the spout 60 is attached to a position that is located at one side of the pouch body 20 and closer to the body bottom 20*a* than a center in a height direction, and the first fixing portion 71 having the first film-through portion 76*a* is formed at the body bottom 20*a*. Thus, when filling the pouch body 20 with a content fluid through the spout 60 while holding the spout 60 to hang the pouch 10, gas such as air in the pouch body 20 can be passed through the first film-through portion 76*a*, so that gas such as air in the pouch body 20 can be properly discharged to the outside. In other words, in a state in which the spout 60 is held to hang the pouch 10, as illustrated in FIG. 4, the first fixing portion 71 having the first film-through portion 76*a* is placed upward. Thus, when the pouch body 20 is filled with a content fluid L through the spout 60, gas A such as air in the pouch body 20 can be smoothly passed through the first film-through portion 76*a* and can be discharged to the outside from the spout 60. In the filling method of the content fluid in FIG. 4, the content fluid is supplied into the pouch 10 in a folded state (not expanded, the front-side film 30 and the back-side film 40 in contact with each other), the content fluid may be supplied into the pouch 10 unfolded in advance.

Figure 5:
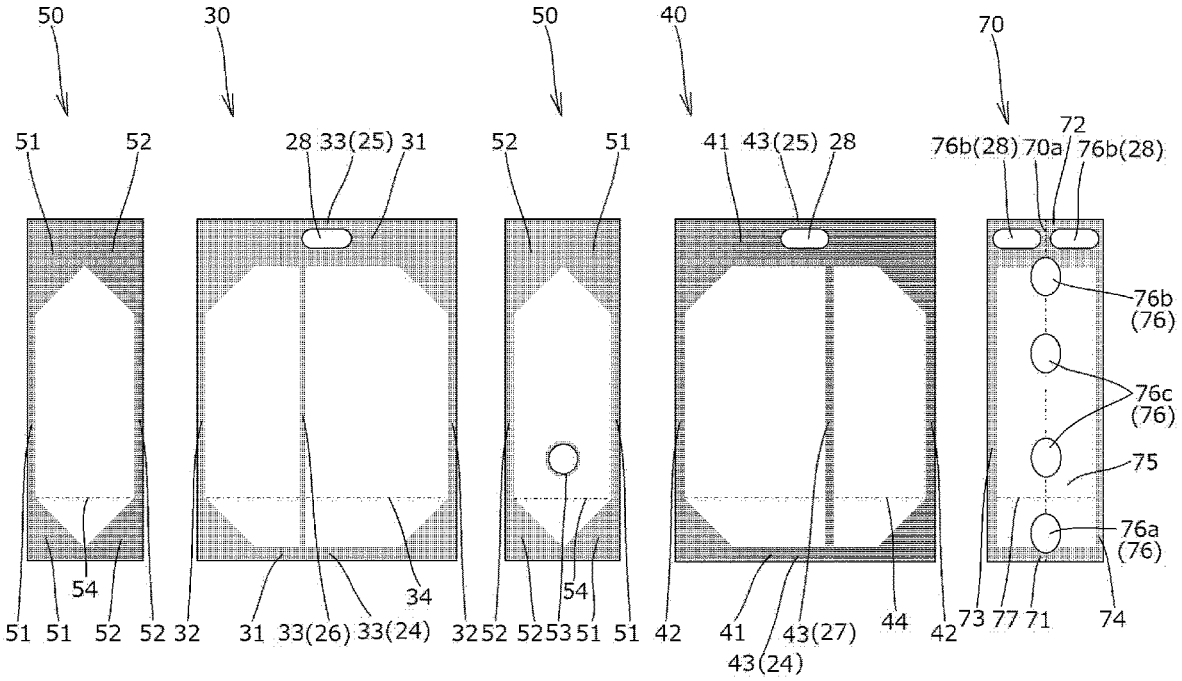
FIG. 5 is an explanatory drawing illustrating films constituting a pouch according to a second embodiment.
Figure 6:
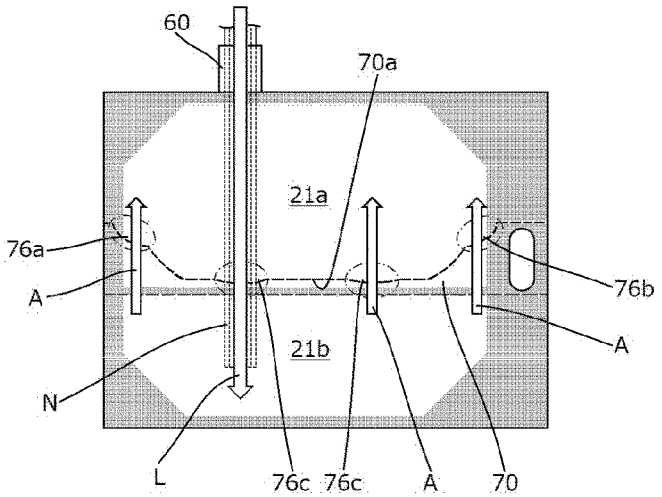
FIG. 6 is an explanatory drawing illustrating the pouch being filled with a content fluid according to the second embodiment.

Referring to FIGS. 5 and 6, a pouch 10 according to a second embodiment of the present invention will be described below. The second embodiment is completely identical to the first embodiment except for some configurations, and thus a description of configurations other than differences is omitted.

In the second embodiment, as illustrated in FIG. 5, one of second film-through portions 76*b* is formed over a second fixing portion 72 and an inner placement portion 75.

The second film-through portion formed over the second fixing portion 72 and the inner placement portion 75 is overlapped on the body films 30 and 40 in bag-making sealing portions 23.

In the second embodiment, as illustrated in FIG. 6, the pouch 10 in an unfolded state (expanded, the front-side film 30 and the back-side film 40 separated from each other) is placed with a second storage region 21*b* located under a first storage region 21*a* (more specifically, the orientation of the pouch 10 is kept such that one gusset portion film 50 having a spout 60 is directed upward while the other gusset portion film 50 is directed downward). In this state, one of inner film-through portions 76*c* is disposed below the spout 60.

A filling method for filling, in the pouch 10 of the second embodiment, a content fluid into the pouch 10 will be described below.

First, as illustrated in FIG. 6, the pouch 10 in an unfolded state is placed with the second storage region 21*b* located under the first storage region 21*a*, and then a filling nozzle N is vertically inserted into the second storage region 21*b* from the outside of the pouch 10 through a spout outlet (not illustrated), which is formed in the spout 60, and the inner film-through portion 76*c*.

Subsequently, as illustrated in FIG. 6, a content fluid discharged from the filling nozzle N is supplied into the pouch 10, thereby filling the pouch 10 with the content fluid.

When the unfolded pouch 10 is filled with a content fluid, a substantial amount of gas (air) in the second storage region 21*b* needs to be moved to the first storage region 21*a* to suppress the foaming of the content fluid in the pouch 10 while the content fluid is supplied into the second storage region 21*b*. In the second embodiment, gas in the second storage region 21*b* can be moved to the first storage region 21*a* through the first film-through portion 76*a* and the second film-through portions 76*b* (and inner film-through portions 76*c*) while a content fluid from the filling nozzle N is supplied into the second storage region 21*b*. This can properly suppress the foaming of the content fluid in the pouch 10.

In the second embodiment, as a content fluid is supplied, the filling nozzle N is moved upward according to the height of the fluid level of the content fluid in the pouch 10. The filling nozzle N may be kept at the same position during the filling of the content fluid.

The embodiments of the present invention were described in detail. The present invention is not limited to the specific embodiments, and the design can be changed in various ways without departing from the present invention described in the claims. Furthermore, the configurations of the embodiments and modifications, which will be described later, may be optionally combined to configure the pouch 10.

For example, in the foregoing embodiments, the pouch 10 stored in an outer case (not illustrated) is handled when being used, displayed, or transported. The pouch 10 may be used, displayed, or transported without being stored in an outer case (not illustrated).

The specific configurations of the films 30 to 50 constituting the pouch body 20 may include a single heat-sealing layer or any layers stacked on a heat-sealing layer if a heat-sealing layer made of olefins such as low-density polyethylene and polypropylene or polyesters such as PET (polyethylene terephthalate) is formed on at least one surface. The stacked layers may be made of any materials. The layers may be optionally formed by stacking known polyesters such as PET and PBT (polybutylene terephthalate), polypropylene, polyamide, polyethylene, and aluminum foil.

In the foregoing embodiments, the pouch body 20 is composed of four body films: the front-side film 30, the back-side film 40, and the pair of gusset portion films 50. The specific configuration of the pouch body 20, for example, the number of body films constituting the pouch body 20 is not limited thereto.

In the foregoing embodiments, the pouch body 20 is formed as a pouch of a so-called horizontal gusset type with the gusset portions 22 formed on both sides. The pouch body 20 may have any specific configuration, for example, a pouch of a so-called bottom gusset type with a single gusset portion 22 or a pouch having three gusset portions 22 on both sides and the bottom.

In the foregoing embodiments, the spout 60 is attached to the gusset portion 22 (gusset portion film 50). The specific arrangement of the spout 60 is not limited thereto, and the spout 60 may be freely arranged. Alternatively, the pouch 10 may be configured with an outlet formed by cutting a part of the pouch body 20 in the absence of the spout 60.

The method of fixing the inner film 70 to the pouch body 20 is not limited to the heat-sealing. The inner film 70 may be fixed by any method, for example, bonding with an adhesive.

In the foregoing embodiments, all the film through portions 76 are formed like holes passing through the inner film 70 in the film thickness direction. At least one of the film through portions 76 may be formed like a notch reaching the outer edge of the inner film 70.

Moreover, the specific number, arrangement, shapes of the film through portions 76 (the first film-through portion 76*a*, the second film-through portions 76*b*, the inner film-through portions 76*c*) are not limited.

In the foregoing embodiments, the first film-through portion 76*a* is formed over the first fixing portion 71 and the inner placement portion 75. At least a part of the first film-through portion 76*a* needs to be formed in the first fixing portion 71, and the first film-through portion 76*a* may be entirely formed in the first fixing portion 71.

The second film-through portions 76*b* does not always need to be formed.

In the foregoing embodiments, the inner film-through portions 76*c* do not overlap the body film in the bag-making sealing portion 23. The inner film-through portions 76*c* may be formed to overlap the body film in the bag-making sealing portion 23.

The film bending portion 70*a* is formed on the inner film 70. The film bending portion 70*a* does not always need to be formed on the inner film 70.

In the foregoing embodiments, the first film-through portion 76*a* are formed over the to-be-bent portion 77. Other film through portions 76 (e.g., the inner film-through portions 76*c*) may be formed over the to-be-bent portion 77.

In the foregoing embodiments, the inner film-through portions 76*c* are formed over the fluid-level contact portion 78. Other film through portions 76 (e.g., the second film-through portions 76*b*) may be formed over the fluid-level contact portion 78.

In the foregoing embodiments, the first fixed portion 24 of the pouch body 20 is a part of the bag-making sealing portion 23 on the bottom side, and the second fixed portion 25 is a part of the bag-making sealing portion 23 on the top side. The specific positions of the first fixed portion 24 and the second fixed portion 25 may be any positions in the positional relationship where the fixed portions are opposed to each other with the content fluid storage portion 21 interposed therebetween. The positions can be optionally changed for a desired effect of suppressing the body expansion of the pouch body 20.

Likewise, in the foregoing embodiments, the third fixed portion 26 of the pouch body 20 is a part of the inner side of the front-side film 30, and the fourth fixed portion 27 is a part of the inner side of the back-side film 40. The specific positions of the third fixed portion 26 and the fourth fixed portion 27 may be any positions in the positional relationship where the fixed portions are opposed to each other with the content fluid storage portion 21 interposed therebetween.

Moreover, the specific number and arrangement of the inner films 70 and the pattern of fixation to the films 30, 40, and 50 may be optionally determined if the first fixing portion 71 and the second fixing portion 72 are provided.

The third fixing portion 73 and the fourth fixing portion 74 may be absent on the inner film 70. In other words, the inner film 70 may be fixed to the pouch body 20 only with the first fixing portion 71 and the second fixing portion 72.

In the present specification, terms such as "top", "bottom", and "side" that indicate the upper-lower relationship are used. These terms do not limit the orientation of the pouch 10 installed when being displayed or transported. For example, when being displayed or transported, the pouch 10 may be installed with one side or the top placed at the bottom of the pouch.

REFERENCE SIGNS LIST

10 Pouch
20 Pouch body
20*a* Body bottom
21 Content fluid storage portion
21*a* First storage region
21*b* Second storage region
22 Gusset portion
23 Bag-making sealing portion
24 First fixed portion
25 Second fixed portion
26 Third fixed portion
27 Fourth fixed portion
28 Through hole
30 Front-side film (body film)
31 First heat-sealing region
32 Second heat-sealing region
33 Third heat-sealing region
34 To-be-bent portion
40 Back-side film (body film)
41 First heat-sealing region
42 Second heat-sealing region
43 Third heat-sealing region
44 To-be-bent portion
50 Gusset portion film (body film)
51 First heat-sealing region
52 Second heat-sealing region
53 Third heat-sealing region
54 To-be-bent portion
60 Spout
70 Inner film
70*a* Film bending portion
71 First fixing portion
72 Second fixing portion
73 Third fixing portion
74 Fourth fixing portion
75 Inner placement portion
76 Film through portion
76*a* First film-through portion
76*b* Second film-through portion
76*c* Inner film-through portion
77 To-be-bent portion
78 Fluid-level contact portion

The invention claimed is:

1. A pouch having a gusset portion, the pouch comprising a pouch body formed like a bag by heat-sealing a plurality of body films to form a bag-making sealing portion, and an inner film disposed in the pouch body, wherein the pouch body includes a content fluid storage portion, and a first fixed portion and a second fixed portion that are opposed to each other with the content fluid storage portion interposed between the fixed portions, the inner film includes a first fixing portion fixed to the first fixed portion, a second fixing portion fixed to the second fixed portion, an inner placement portion that is disposed in the pouch body without being fixed to the pouch body, and a plurality of film through portions that are formed like holes penetrating in a film thickness direction or notches, the plurality of film through portions include a first film-through portion at least partially formed on the first fixing portion, and an inner film-through portion formed on the inner placement portion, and the first film-through portion is overlapped on the body film in the bag-making sealing portion.

2. The pouch according to claim 1, wherein the first film-through portion is formed over the first fixing portion and the inner placement portion.

3. The pouch according to claim 2, further comprising a spout attached to the pouch body, wherein the pouch body includes a body bottom, the spout is attached to a position that is located at one side of the pouch body and closer to the body bottom than a center in a height direction, and the first fixing portion is formed at the body bottom.

4. The pouch according to claim 1, wherein the plurality of film through portions include a second film-through portion at least partially formed on the second fixing portion, and the second film-through portion is overlapped on the body film in the bag-making sealing portion.

5. The pouch according to claim 1, further comprising a spout attached to the pouch body, wherein the pouch body includes a body bottom, the inner film has a to-be-bent portion that is bent at the body bottom when the pouch containing a content fluid is placed on a loading surface with the body bottom placed at a bottom of the pouch, and at least one of the film-through portions is formed over the to-be-bent portion.

6. The pouch according to claim 1, further comprising a spout attached to the pouch body, wherein the pouch body includes a body bottom, the content fluid storage portion includes a first storage region and a second storage region that are separated by the inner film, the inner film has a fluid-level contact portion that comes into contact with a fluid level of a content fluid when the sealed pouch containing the content fluid is placed on the loading surface with the body bottom placed at the bottom of the pouch, and at least one of the film-through portions is formed over the fluid-level contact portion.

7. The pouch according to claim 1, wherein the inner film is configured as a resin film having a heat-sealing layer, and the first fixing portion is disposed between the two body films and is heat-sealed to the two body films in the bag-making sealing portion so as to be fixed to the pouch body.

8. The pouch according to claim 7, wherein the inner film is configured as a resin film having a heat-sealing layer and is bent into two with the heat-sealing layer facing outward, and the first fixing portion and the second fixing portion that are bent into two are disposed between the two body films and are heat-sealed to the two body films in the bag-making sealing portion.

9. The pouch according to claim 8, further comprising a spout attached to the pouch body, wherein the provided inner film is at least one inner film, the content fluid storage portion includes a first storage region and a second storage region that are separated by the inner film, the spout is attached to a position where the spout communicates with the first storage region, and the inner films are all installed such that the film bending portion faces the first storage region, the film bending portion being formed by bending the inner film into two.

10. The pouch according to claim 9, wherein at least one of the film-through portions is formed over the film bending portion.

11. A filling method for filling the pouch according to claim 1 with a content fluid, wherein the plurality of film through portions include the second film-through portion at least partially formed on the second fixing portion, the second film-through portion is overlapped on the body film in the bag-making sealing portion, the first film-through portion is formed over the first fixing portion and the inner placement portion, the second film-through portion is formed over the second fixing portion and the inner placement portion, the content fluid storage portion includes the first storage region and the second storage region that are separated by the inner film, and the spout having a spout outlet is attached to a position where the spout communicates with the first storage region of the pouch body, the method comprising, with the second storage region located under the first storage region, inserting a filling nozzle into the second storage region from outside of the pouch through the spout outlet and the inner film-through portion; and moving gas in the second storage region into the first storage region through the first film-through portion and the second film-through portion while supplying the content fluid from the filling nozzle into the second storage region during the filling of the content fluid.

* * * * *